US006595806B2

(12) United States Patent
Mochizuki

(10) Patent No.: US 6,595,806 B2
(45) Date of Patent: Jul. 22, 2003

(54) CONNECTOR

(75) Inventor: Shinji Mochizuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/188,039

(22) Filed: Jul. 3, 2002

(65) Prior Publication Data

US 2003/0008567 A1 Jan. 9, 2003

(30) Foreign Application Priority Data

Jul. 4, 2001 (JP) ..... 2001-203696

(51) Int. Cl.[7] ..... H01R 13/502
(52) U.S. Cl. ..... 439/701
(58) Field of Search ..... 439/701, 695, 439/686, 404, 942

(56) References Cited

U.S. PATENT DOCUMENTS 5,700,163 A * 12/1997 Okabe ..... 439/701
5,893,778 A * 4/1999 Mansutti ..... 439/701
5,957,732 A * 9/1999 Ito et al. ..... 439/701
6,358,098 B1 * 3/2002 Wakata ..... 439/701

FOREIGN PATENT DOCUMENTS

JP 2000-231959 8/2000

* cited by examiner

*Primary Examiner*—Tho D. Ta
(74) *Attorney, Agent, or Firm*—Sughrue Mion, PLLC

(57) ABSTRACT

Partition walls (3) are formed on a strip-like base plate (2), and extend in a width direction thereof, and are spaced at predetermined intervals, and a bridge member (4) bridges between any two adjacent partition walls (3). Convex portions (7) are formed on upper surfaces of the bridge members (4), respectively, and notches (5) are formed respectively in those portions of the base plate (2) disposed respectively corresponding to the bridge member (4). With this construction, a molded insulating housing (1) will not be deformed by shrinking, and the insulating housings, when stacked together, will not be displaced out of position as indicated by imaginary lines. And besides, the insulating housing can be molded by molds of a simple construction, and therefore the production cost can be reduced.

7 Claims, 12 Drawing Sheets

CONNECTOR

The present application is based on Japanese Patent Application No. 2001-203696, which is incorporated herein by reference.

BACKGROUND OF THE INVENTION

1. Field of the Invention

This invention relates to a connector, and more particularly to a connector suited for a wire harness for electrically connecting, for example, control equipments and electronic equipments mounted on an automobile.

2. Related Art

Automated controls for various vehicles, including passenger cars, have been advanced, and with this advance various control equipments or devices, such as a CPU, and electronic equipments have been mounted on the vehicle.

Such control equipments and electronic equipments are connected by a wire harness, and the wire harness includes a connector which can be detachably connected in an inserted manner to a terminal connector mounted on the control equipment or the like.

One example of conventional connectors will now be described with reference to FIGS. 13 to 16.

As shown in FIG. 13, the connector 100 comprises insulating housings 101, terminals 102, and a cover member 103. The insulating housing 101 is formed into a strip-like shape, and as illustrated in FIG. 4 which shows part of the insulating housing on an enlarged scale, partition walls 105 are formed on a continuous base plate 104 (or merely "continuous plate") at predetermined intervals, and extend continuously in a width direction of this base plate. A groove-like space, formed between any two adjacent partition walls 105, serves as a terminal receiving portion 106 for receiving the terminal 102.

A number of (for example, 50) terminal receiving portions 106 are formed on the single continuous base plate 104, and this is called "a fifty-row structure", and the base plate is cut into a predetermined length, and this section is used as a component part of the connector 100.

The terminal 102 is formed by pressing or working an electrically-conductive metal sheet into a predetermined shape, and this terminal includes a connection portion 102*a* for connection to a mating connector, and two pairs of press-contacting blades 102*b* to which a wire 107 can be press-contacted. Other example of the terminal 102 than such a press-contacting terminal is a press-clamping terminal, and either can be used.

The terminals 102 are inserted into the terminal receiving portions 106, respectively, and each terminal 102 is positioned as shown in FIG. 14, and in this condition the wire 107, having a sheath, is press-fitted into a gap between each pair of press-contacting blades 102*b* as indicated by arrow A. As a result, the press-contacting blades 102*b* cut the sheath 107*a* of the wire 107, and then come into contact with a conductor 107*b*, thereby electrically connecting the terminal 102 to the wire 107.

In the connector 100 shown in FIG. 13, the terminals 102 are inserted in the respective terminal receiving portions 106, and the insulating housing 101, having the wires 107 connected thereto, is cut to provide five-row sections, and these housing sections are stacked together in a four-stage manner, and this stack is fitted into the cover member 103. The cover member 103 is integrally molded of a synthetic resin.

The connection portions 102*a* of the terminal 102 are exposed to one side surface of the connector 100, and the wires 107 are extended outwardly from the rear side surface of the connector.

The insulating housing 101 is molded of a synthetic resin, using molds, and is produced by a molding method (producing method) shown in FIG. 15.

More specifically, filling portions 112, corresponding in shape to the insulating housing 101, are formed respectively in opposed side surfaces of a pair of molds 111*a* and 111*b* as shown in FIG. 15. Filling portions for molding the partition walls 105 are formed in a reverse surface of the mold 111*a*.

For molding the insulating housing 101, the molds 111*a* and 111*b* are driven respectively in directions of arrow B so as to join the filling portions 112 together, and then a synthetic resin is poured. Then, after the synthetic resin is solidified, the molds 111*a* and 111*b* are driven respectively in directions of arrow C, and therefore are moved apart from each other, thereby obtaining the insulating housing 101.

In the above mold structure, when moving the molds 111*a* and 111*b* into and out of mating engagement with each other, the stroke of each of the molds 111*a* and 111*b* in the direction of arrow B and the direction of arrow C is short, and therefore even a narrow operating space is acceptable, and besides the operability is excellent. However, the following problem has been encountered with the produced insulating housing 101.

Namely, it is preferred that the insulating housing 101 should have a flat plate-like shape as shown in an upper portion of FIG. 16.

However, the insulating housing was often warped or curved by the shrinking appearing after the molding, as shown in a lower portion of FIG. 16. It may be proposed to provide reinforcing members, interconnecting the partition walls 105, in order to prevent the deformation due to the shrinking. With this construction, however, it is necessary to add a slide mold to the molds 111*a* and 111*b*, and therefore there is encountered a problem that the mold structure becomes complicated, so that the cost increases.

SUMMARY OF THE INVENTION

This invention has been made in view of the above problem and an object of the invention is to provide a connector employing an insulating housing of such a structure that this housing is less liable to be deformed.

(1) The above object of the invention has been achieved by a connector comprising:

at least one insulating housing, including a strip-like base plate having a longitudinal direction thereof and a width direction thereof perpendicular to the longitudinal direction, the base plate being cut into a predetermined length in the longitudinal direction from a continuous plate which has a plurality of terminal receiving portions, a plurality of partition walls formed on the base plate, and extending continuously in the width direction of the base plate, and the partition walls being juxtaposed at a predetermined interval in the longitudinal direction of the base plate, a bridge member having bridging portions each of which bridges between two adjacent ones of the partition walls, and a plurality of notches each of which is formed at a position directly below the bridging portions on the base plate;

a plurality of terminals disposed respectively along the partition walls; and a cover member receivable the insulating housing.

In the connector of this construction, the bridge member bridges between any two adjacent partition walls extending upright from the base plate, and therefore deformation due to shrinking will not occur thanks to the cooperation of the bridge members with the base plate.

The notches are formed respectively at positions corresponding to the bridge members on the base plate disposed respectively, and therefore molds for molding the bridge members can be produced, utilizing these notches, and a slide mold for molding the bridge members is not necessary.

(2) In the invention, a plurality of convex portions project from the bridge member in a thickness direction of the base plate, and the convex portions have an outer shape corresponding to an inner shape of the notch. Therefore, when stacking the adjacent insulating housings, the insulating housings can be positioned with respect to each other by fitting the convex portions in the respective notches.

In the case where insulating housings are stacked together in a plurality of stages, the upper and lower insulating housings can be easily separated from each other when convex portions on the lower housing are merely fitted respectively in notches in the upper housing. Therefore, preferably, suitable projections are formed respectively in the notches in the upper insulating housing, and the convex portions on the lower insulating housing can be retainingly engaged with these projections, respectively.

In this case, however, it is necessary to form a recess in that portion of each convex portion corresponding to the projection, and therefore for providing the convex portion and the projection at the same region, a mold structure for injection molding the insulating housing need to include a slide mold.

(3) In the present invention, the convex portions are formed alternately on one of each two of the bridging portions, and the insulating housings are stacked in at least two stages, and the convex portions on an upper one of any two adjacent insulating housings are arranged in a staggered manner to the convex portions on a lower one of this two insulating housings.

With this staggered arrangement, the convex portions, formed on the lower insulating housings, are fitted respectively at positions on the upper insulating housings where the convex portions are not formed.

In this connector, when the plurality of insulating housings each having the alternately-arranged convex portions, are stacked together, the convex portions of the stacked insulating housings are arranged in a staggered manner. Therefore, it is not necessary to provide the convex portion and the projection at the same region, and as a result the mold structure for injection molding the insulating housing does not need to include a slide mold.

(4) In the invention, the convex portions are formed respectively on the bridging portions of the insulating housing. In this case, when a required number of insulating housings are cut, and are stacked together, the convex portions never fail to be disposed respectively corresponding to the corresponding notches regardless of this number.

(5) As described above, in the invention, the convex portions may be engageable with the notches.

(6) That is, in the invention, a recess may be formed on a back side of at least one of the convex portions and a projection may formed at a front end of the base plate in at least one of the notches, so that the recess is engaged with the projection.

(7) In the invention, the projection may be formed at a front end of the base plate in the notch directly below the other of the two bridging portions where the convex portion is not formed.

DETAILED DESCRIPTION OF THE PREFERRED EMBODIMENTS

Figure 13:
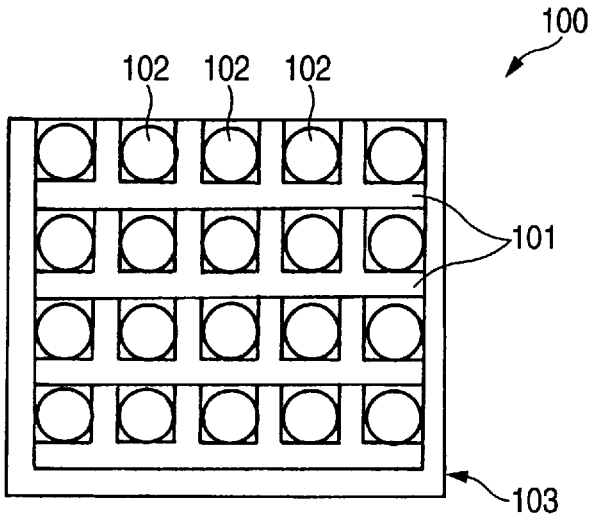
FIG. 13 is a side-elevational view showing the construction of a conventional connector.
Figure 14:
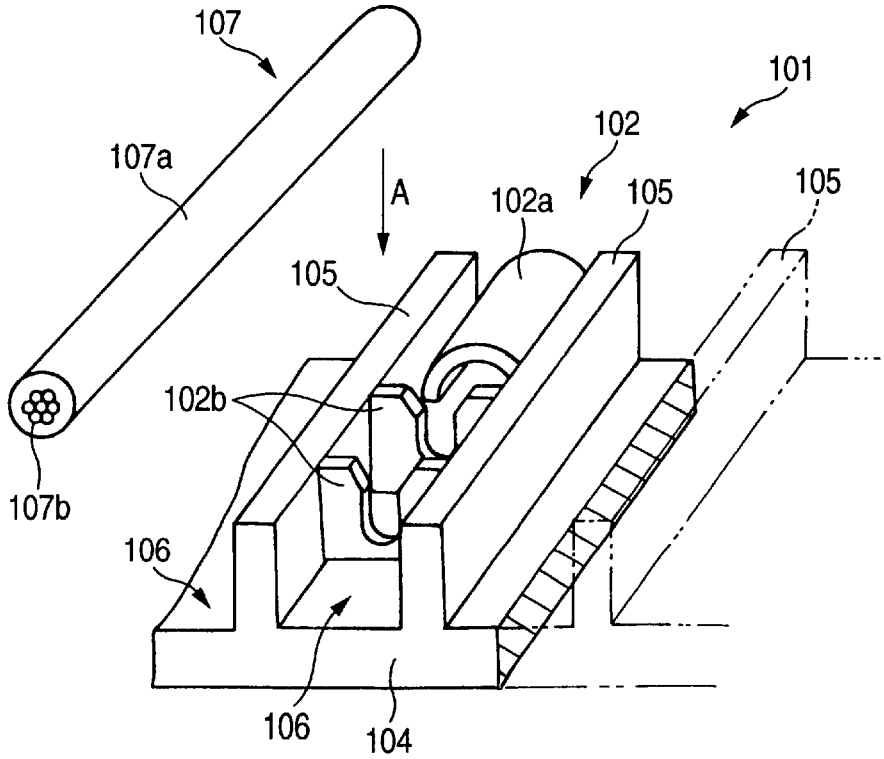
FIG. 14 is a perspective view showing the construction of a conventional insulating housing.
Figure 15:
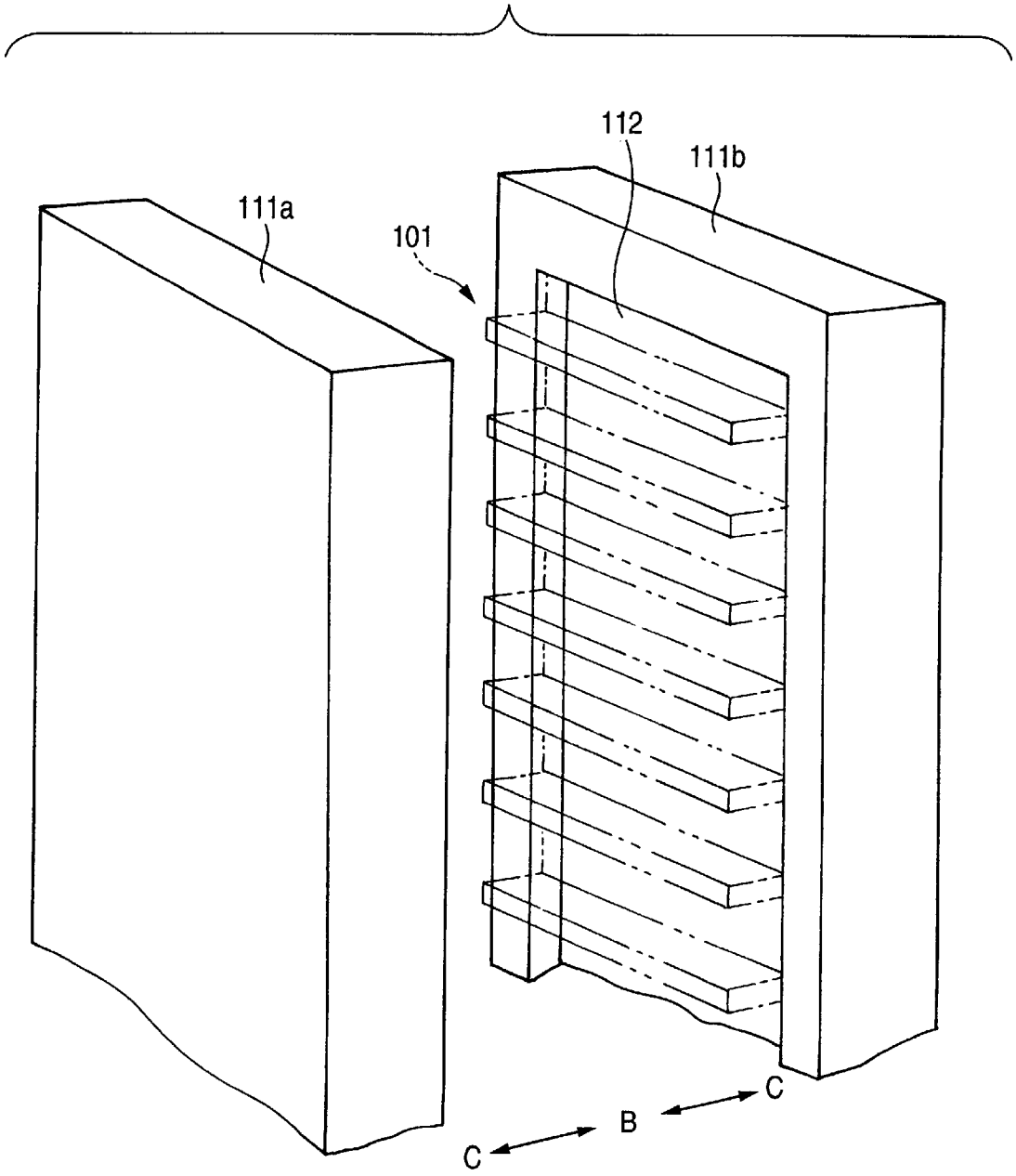
FIG. 15 is a perspective view showing the molding of the insulating housing.
Figure 16:
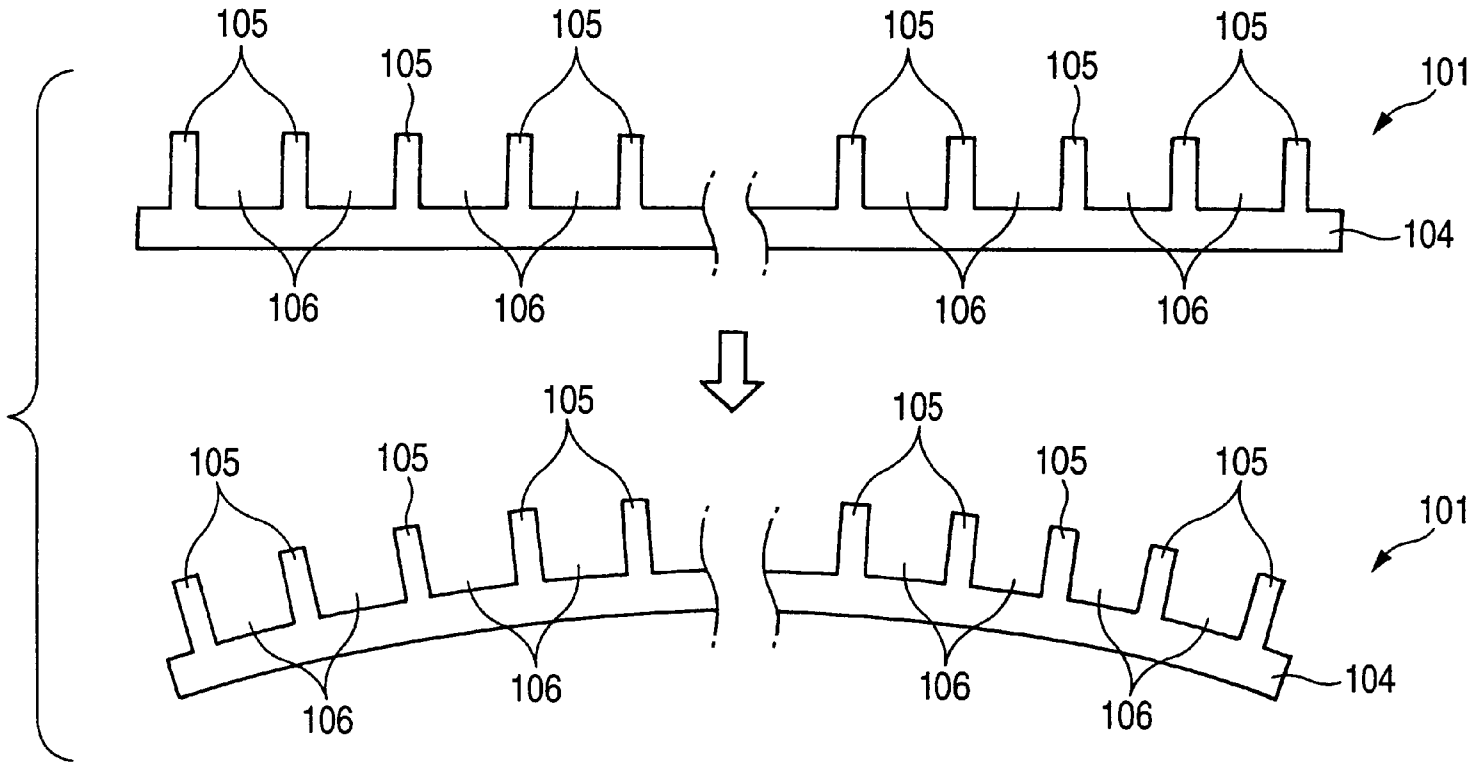
FIG. 16 is a schematic view explanatory of the deformation of the insulating housing.

A first embodiment of the present invention will now be described in detail with reference to the drawings. In the embodiments which will be described hereafter, those members, already described with reference to FIGS. 13 and 16, will be designated by identical or like reference numerals, and explanation thereof will be made briefly or omitted.

Figure 1:
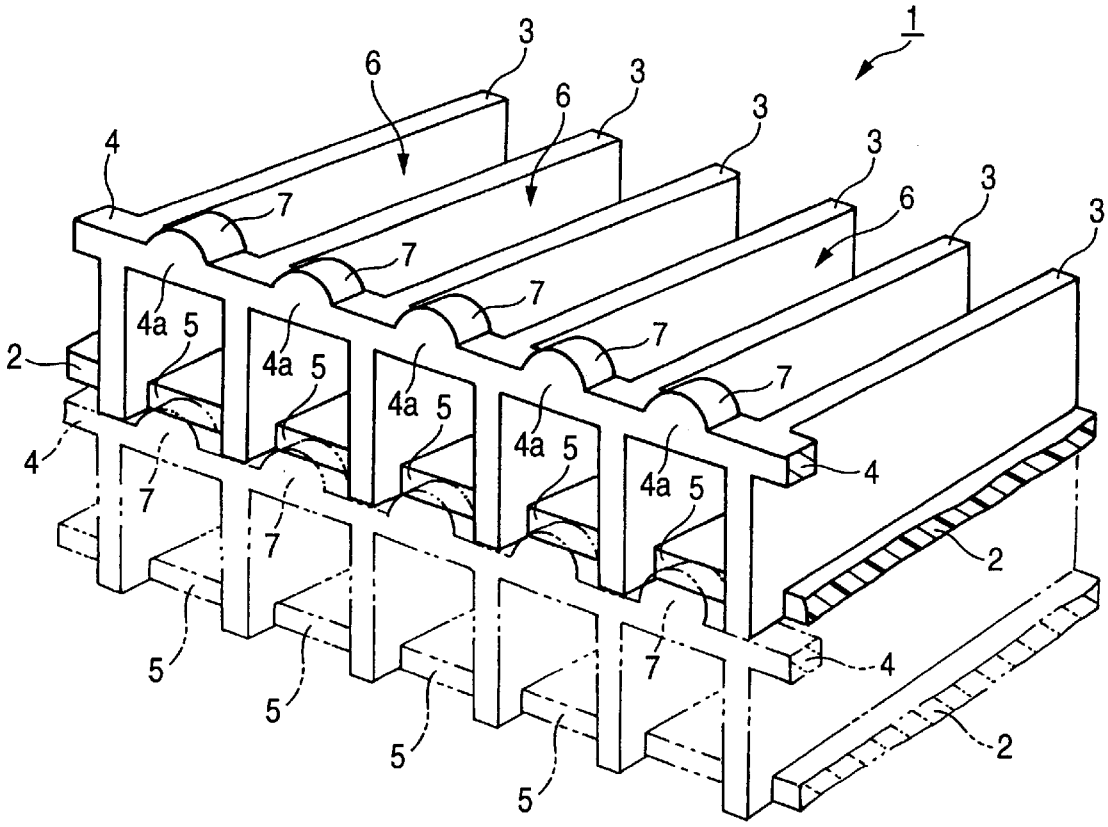
FIG. 1 is a perspective view showing a first embodiment of an insulating housing of the present invention.
Figure 2:
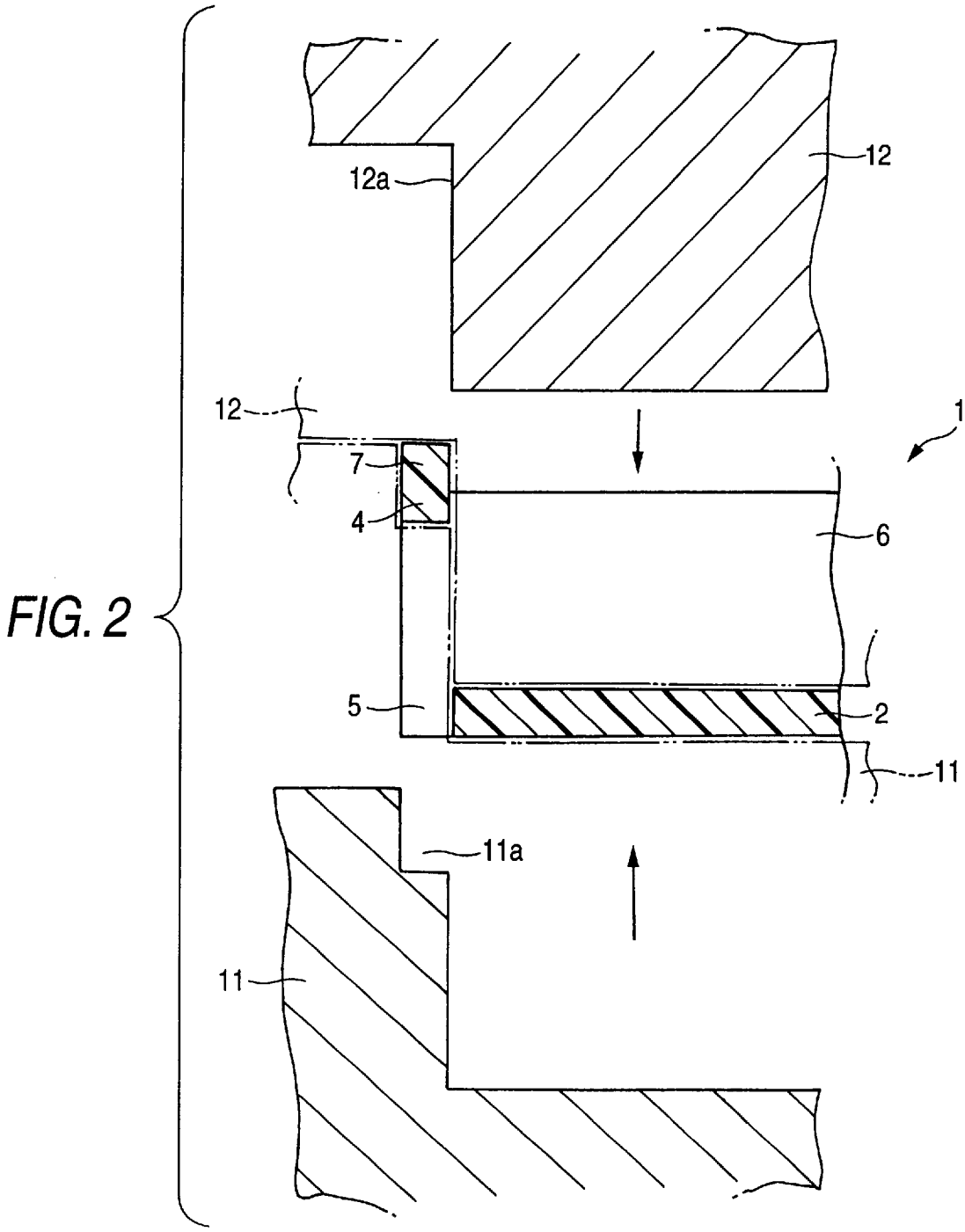
FIG. 2 is a cross-sectional view showing the molding of the insulating housing.

As shown in FIGS. 1 and 2, an insulating housing 1, forming the first embodiment of the invention, includes a strip-like base plate 2, partition walls 3, which are formed on the base plate 2 and spaced at a predetermined interval in a longitudinal direction of the base plate 2 and the partition walls 3 extend continuously in a width direction of the base plate 2, and a bridge member 4 is provided with bridging portions 4*a* bridging between one ends of two adjacent partition walls 3. Notches 5 are formed on the base plate 2, respectively at positions corresponding to the bridging portions 4*a* of the base plate 2, that is, disposed respectively directly below the bridging portions 4*a*.

A groove-like space, formed between any two adjacent partition walls 3, defines a terminal receiving portion 6 for receiving a terminal 102, and in this embodiment, convex portions 7 are formed respectively on upper surfaces of the bridging portions 4*a* of the bridge member 4 corresponding respectively to the terminal receiving portions 6.

For using the insulating housing 1 in a connector, the terminals are inserted respectively into the terminal receiving portions 6, and wires are press-contacted to these terminals, respectively, as in the conventional structure. Then, housing sections, each having a required number of (for example, 5) rows of terminal receiving portions, are cut from the strip-like insulating housing 1, and these are stacked together in a two-stage manner as indicated in imaginary lines in FIG. 1, and this stack is fitted into a cover member (not shown), thereby forming the connector similar to the conventional connector.

When the insulating housings 1 are thus stacked together, the convex portions 7, formed on the lower insulating housing 1, are fitted respectively in the notches 5 formed in the base plate 2 of the upper insulating housing 1. Therefore, the upper and lower insulating housings 1, stacked together, are positioned with respect to each other, and therefore the jolting of these insulating housings, fitted in the cover member, is suppressed.

The insulating housing 1 can be produced by molds of a simple structure as shown in FIG. 2. More specifically, one mold 11, shown at a lower portion of FIG. 2, and the mold 12, shown at an upper portion thereof, are joined together as indicated in imaginary lines in FIG. 2, and a synthetic resin is filled in a cavity (or filling portion) formed between the two molds, thereby molding the insulating housing 1. A step portion 11*a*, which passes through the notches 5 so as to mold the bridge members 4, is formed at the mold 11. A corner portion 12*a* of the other mold 12, shown in the upper portion, is so disposed as to be spaced from the surface of the step portion 11*a* by a distance corresponding to the sum of the thickness of the bridge member 4 and the height of the convex portion 7.

Therefore, when the molds 11 and 12 are joined together, there is formed the cavity for molding the bridging portions 4*a* of the bridge member 4 and the convex portions 7 integrally with each other, and the insulating housing 1, having the bridge member 4, is produced.

If the notches 5 are not provided, there is needed a slide mold which is moved into and out of its molding position in the lateral direction to form the bridge member 4 and the convex portions 7.

However, the provision of the notches 5 obviates the need for such a slide mold.

As described above, the insulating housing 1 of this embodiment has the bridge members 4 including the bridging portions 4*a* each bridging between the adjacent partition walls 3 (formed upright on the base plate 2 at the predetermined intervals). Therefore, the upper side of the insulating housing 1 will not be expanded, and the above-mentioned deformation due to shrinking will not occur.

Therefore, the insertion of the insulating housing into the cover member during the connector-assembling operation is easy, and besides slight position deviation of the terminals after the insertion of the insulating housing is not encountered, so that this connector can be smoothly connected to a mating connector. Furthermore, the convex portions 7 are fitted in the respective notches 5, and therefore the mating connector will not strike against the end of the base plate 2, so that the connection of this connector to the mating connector can be easily effected.

Next, a second embodiment of the invention will be described. This embodiment is directed to an insulating housing and also to a connector provided with the insulating housing, and those members, already shown and described, will be designated by identical or like reference numerals, and explanation thereof will be made briefly or omitted. In the description of this embodiment, the structure of the insulating housing, as well as a method of producing the insulating housing, will first be described with reference to FIGS. 3 to 7, and then examples of use of insulating housings in a connector, will be described.

Figure 3:
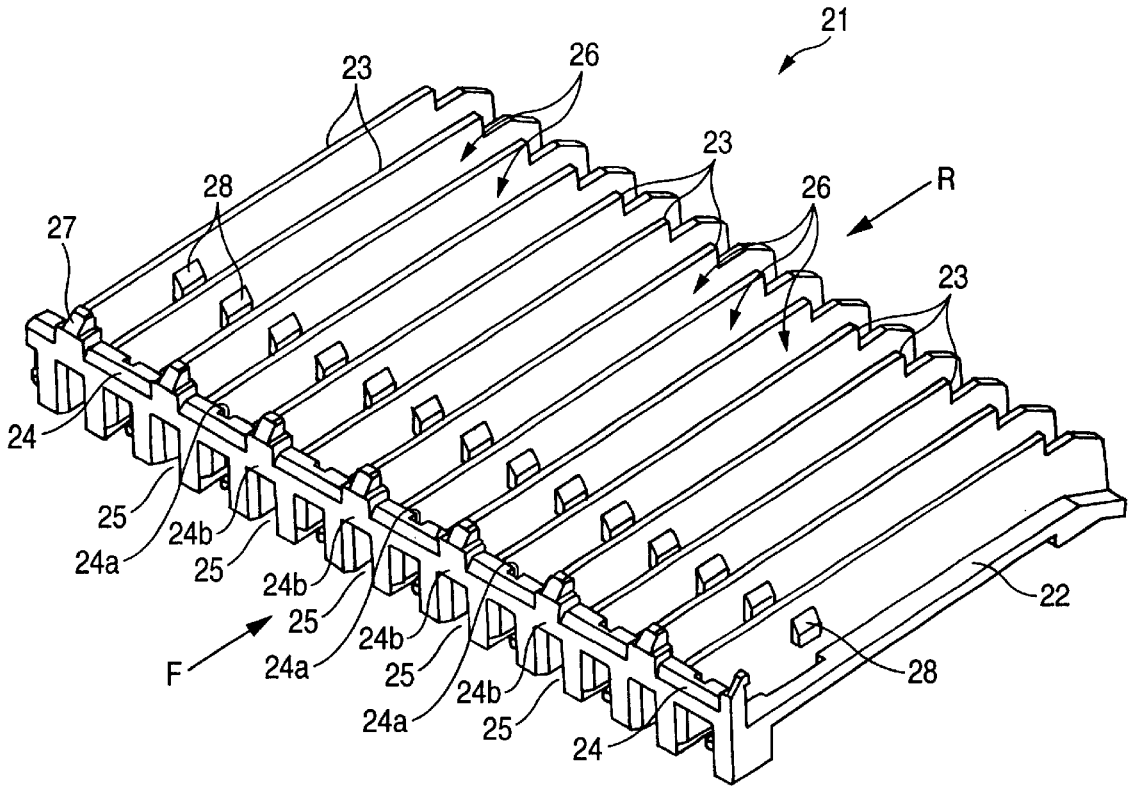
FIG. 3 is a perspective view showing a second embodiment of an insulating housing of the invention.

As shown in FIG. 3, the insulating housing 21 of this embodiment includes a strip-like base plate 22, partition walls 23, which are formed on the base plate 22, and are spaced at predetermined intervals in a longitudinal direction of the base plate 22, and extend continuously in a width direction of the base plate 22, and a bridge member 24 is provided with the bridging portions 24*b* bridging between one ends of any two adjacent partition walls 23. Notches 25 are formed in those portions of the base plate 22 disposed corresponding to the bridging portions 24*b*, that is, disposed directly below the bridging portions 24*b*. The position of formation of each notch 25 will be described later in detail.

A groove-like space, formed between any two adjacent partition walls 23, defines a terminal receiving portion 26 for receiving a terminal 102, and in this embodiment, convex portions 27 are formed alternately on upper surfaces of the bridging portions 24*b* corresponding respectively to the terminal receiving portions 26.

Figure 4:
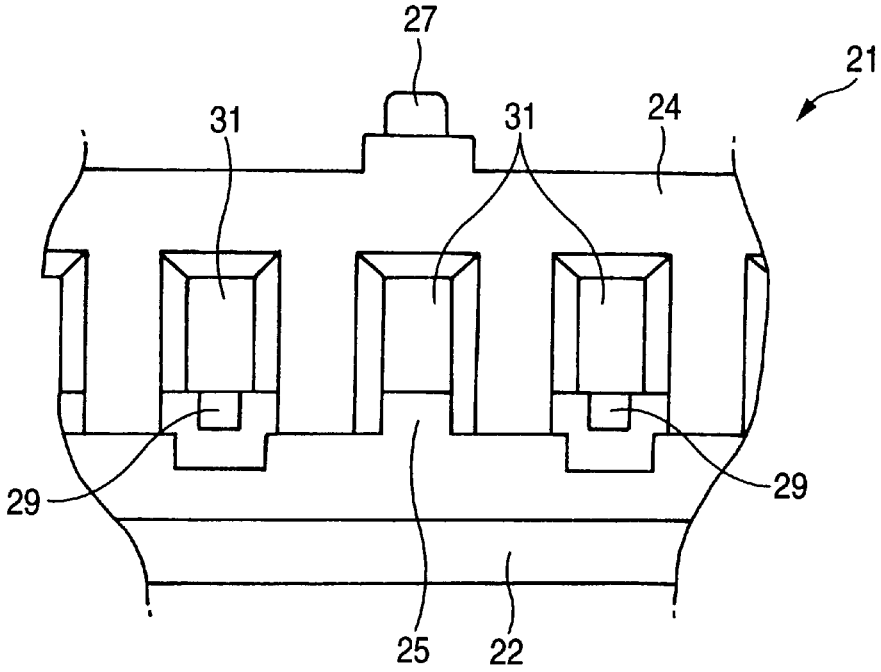
FIG. 4 is an enlarged, fragmentary, side-elevational view showing the construction of the front side of the insulating housing.

When the insulating housing 21 is seen from the front side indicated by arrow F, passage holes 31 for the insertion of a mating connector are formed in this front surface as shown in FIG. 4, and the convex portions 27 are formed above these passage holes 31 in an intermittent manner.

Figure 5:
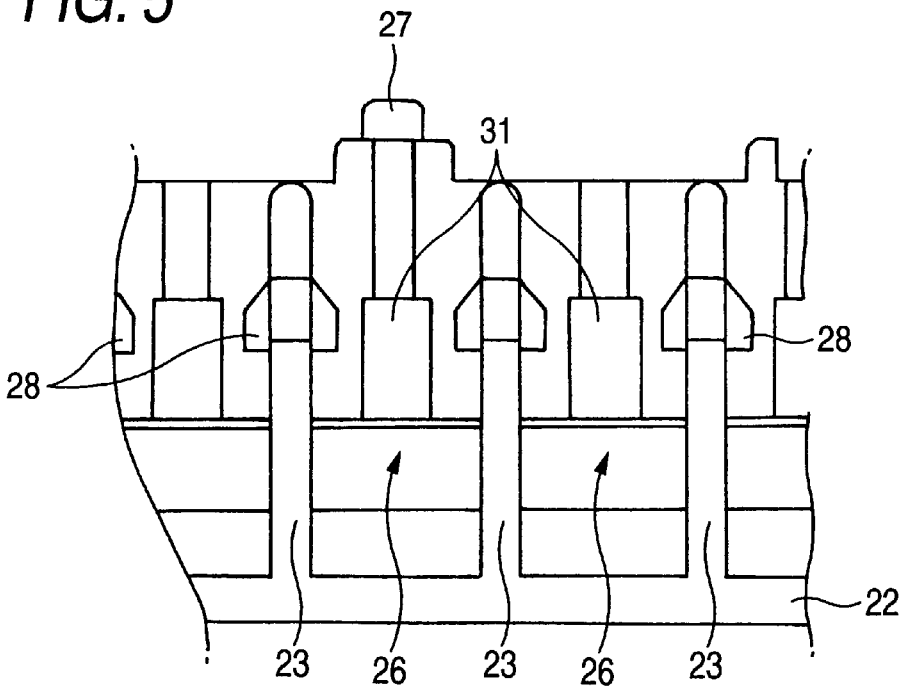
FIG. 5 is an enlarged, fragmentary, side-elevational view showing the construction of the rear side of the insulating housing.

When the insulating housing 21 is seen from the rear side as indicated by arrow R, the partition walls 23 are formed at the predetermined intervals as shown in FIG. 5, and the groove-like space, formed between any two adjacent partition walls 23, defines the terminal receiving portion 26. Retaining projections 28, formed respectively on the opposite side of each partition wall 23, prevent the terminal, received in the terminal receiving portion 23, from being withdrawn therefrom.

Each passage hole 31 is disposed substantially at the center of the corresponding terminal receiving portion 26, and when the terminal is inserted into the terminal receiving portion 26, a connection portion of the terminal passes through the passage hole 31.

Next, the transverse cross-sectional structure of the insulating housing 21 will be described.

Figure 6A:
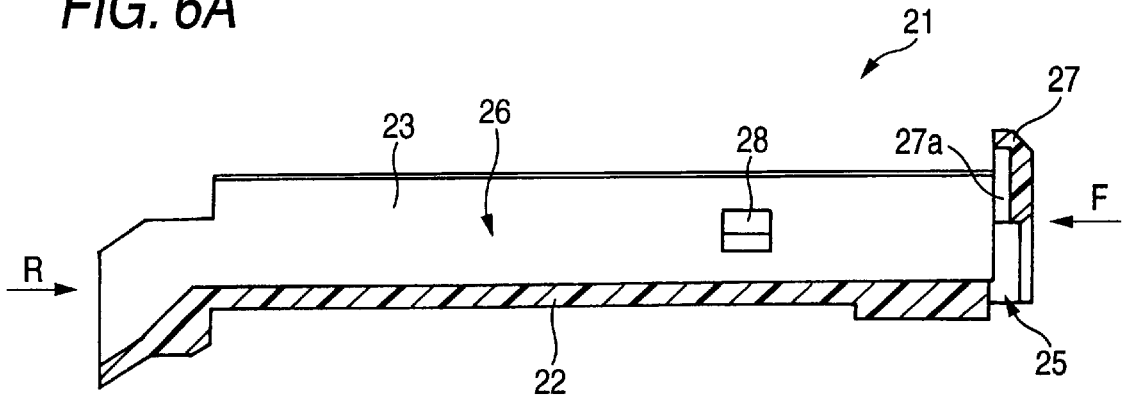
FIG. 6A is a cross-sectional view, showing the construction of that portion of the insulating housing where a convex portion is formed.
Figure 6B:
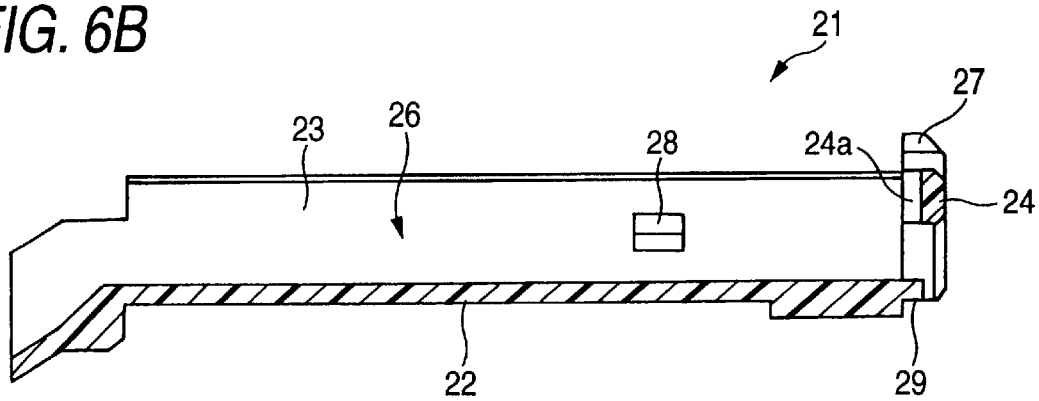
FIG. 6B is a cross-sectional view, showing the construction of that portion of the insulating housing where a projection is formed.

A recess 27*a* is formed in the back side of each convex portion 27, and the notches 25 are formed respectively in those positions of the base plate 22 corresponding respectively to the recesses 27*a* (and hence the convex portions 27), as shown in FIG. 6A. On the other hand, grooves 24*a* are formed respectively in back sides of the bridging portions 24*b* where the convex portions 27 are not formed, as shown in FIG. 6B. The front end of the base plate 22 projects at positions directly below each groove 24*a*, so that projections 29 are formed at the front end of the base plate 22. The relation between the convex portions 27 and the notches 25, as well as the construction of the projections 29 formed at the regions where the convex portions 27 are not formed, is shown also in FIG. 4.

Figure 7A:
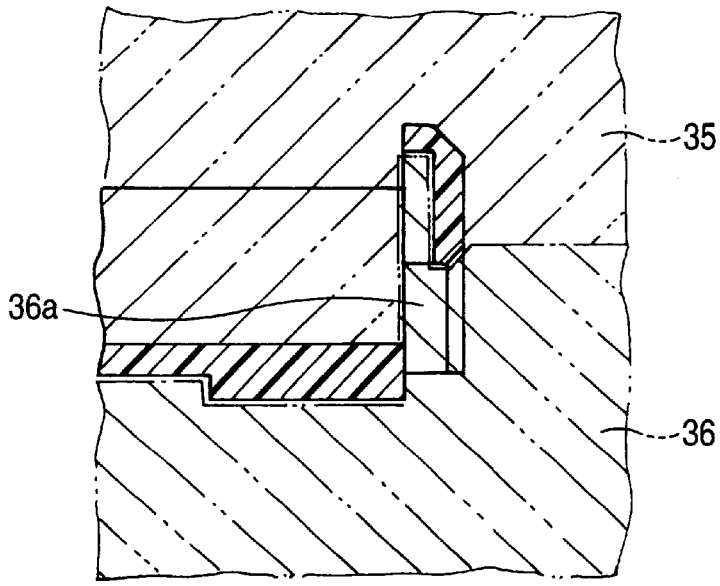
FIG. 7A is a cross-sectional view, showing the molding of that portion of the insulating housing where the convex portion is formed.
Figure 7B:
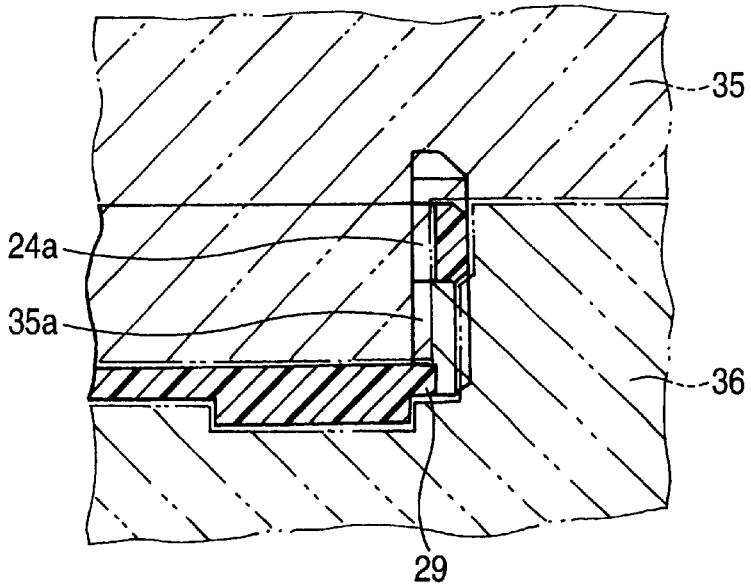
FIG. 7B is a across-sectional view, showing the molding of that portion of the insulating housing where the projection is formed.

Next, molds for molding the insulating housing 21 will be described. As shown in FIGS. 7A and 7B, the insulating housing 21 is molded by the molds 35 and 36. With respect to the regions where the convex portions 27 are formed, the notches 25 are formed respectively at positions of the base plate 22 directly below the convex portions 27, and therefore part of the mold 36 (shown at the lower side) project, and a cavity, that is, a cavity (or filling portion), is formed between each of these projected portions 36*a* and the mold 35 (shown at the upper side), and with this construction, the convex portions 27 can be molded.

On the other hand, with respect to the regions where the convex portions 27 are not formed, part of the upper mold 35 project downwardly through the respective grooves 24*a* to reach the upper surfaces of the respective projections 29, and a cavity, that is, a cavity (or filling portion), is formed between each of these projected portions 35*a* and the lower mold 36, and with this construction, the projections 29 can be molded.

As described above, in this embodiment, also, the bridging portions 24*b* of the bridge member 24, as well as the convex portions 27 each having the key-like recess 27*a* formed in the back side thereof, can be molded. Therefore, it is not necessary to provide any slide mold for molding the convex portion 27, and the molds 35 and 36 can be simplified in construction.

The bridge members 24 are formed at the insulating housing 21, and therefore the insulating housing will not be deformed by shrinking after it is molded.

Next, an example of use of the insulating housing 21 in a connector, will be described.

Figure 8:
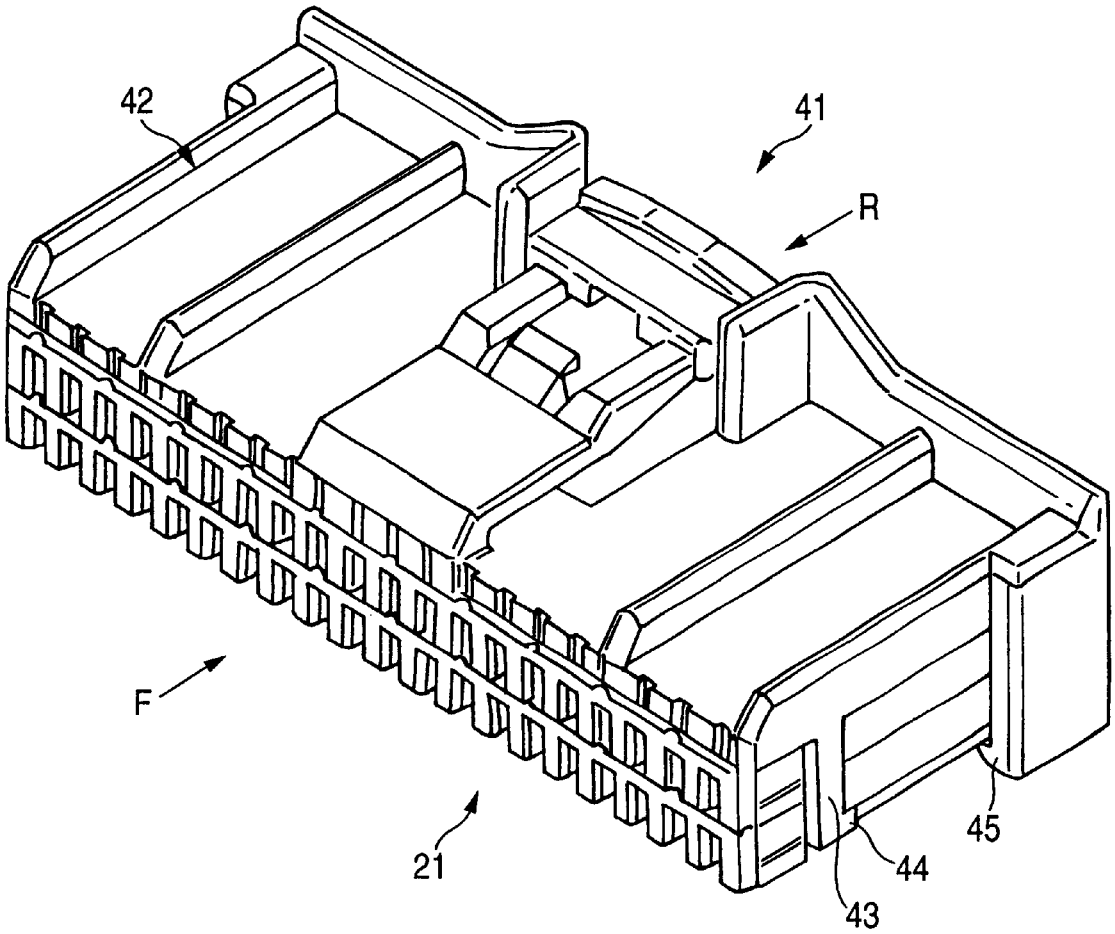
FIG. 8 is a perspective view showing the construction of a connector.

As shown in FIG. 8, insulating housings 21, each cut to a length having a required number of terminal receiving portions, are stacked together in a two-stage manner, and this stack is fitted into a cover member 42, thereby forming the connector 41. The cover member may be either of the lid type and the rectangular tube type, and the cover member 42, shown in FIG. 8, is of the lid type.

Figure 9:
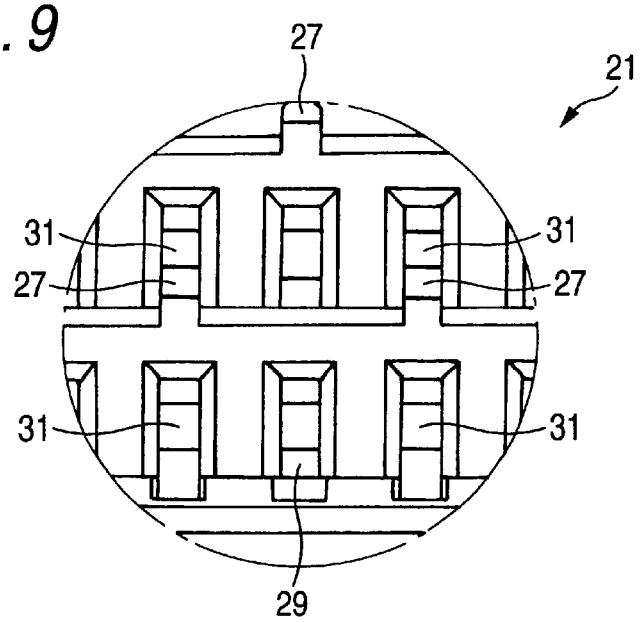
FIG. 9 is a side-elevational view showing the construction of the connector.

When the connector 41 is seen from the front side F, it will be appreciated that the convex portions 27, formed on the lower insulating housing 21, are fitted respectively in those portions of the upper insulating housing 21 where the convex portions 27 are not formed, that is, where the projections 29 are formed, as shown in FIG. 9.

Figure 10:
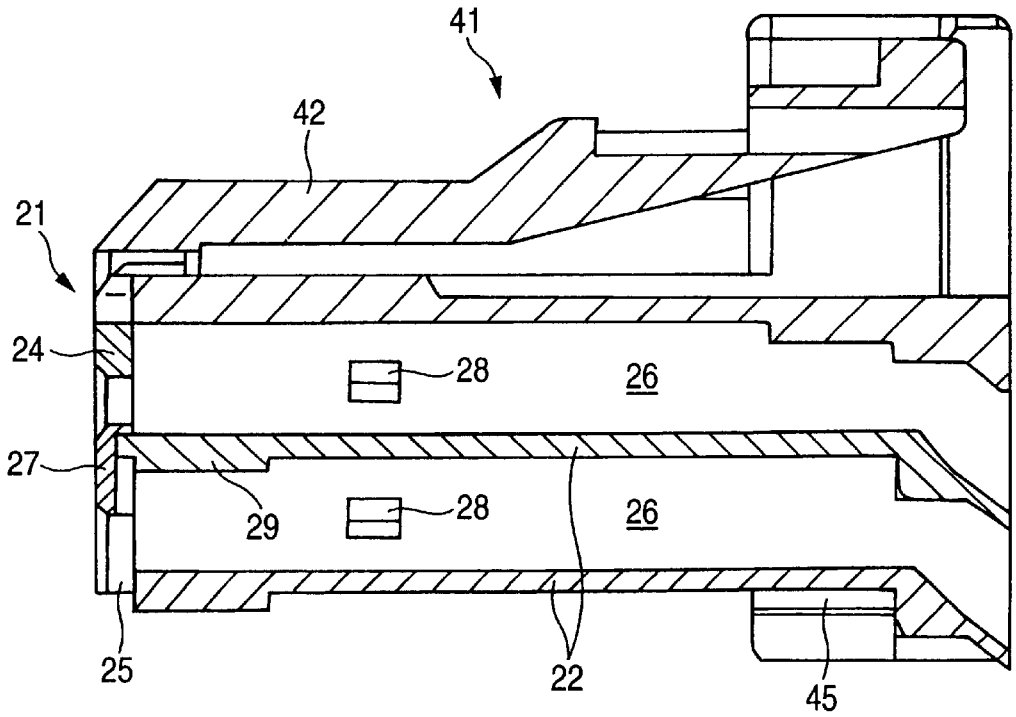
FIG. 10 is a cross-sectional view showing the construction of the connector.

In this construction, the back side of each convex portion 27 on the lower insulating housing 21, that is, the key-like recess 27*a* of each convex portion 27, is retainingly engaged with the corresponding projection 29 on the upper insulating housing 21 in covering relation thereto, as shown in FIG. 10.

A plurality of insulating housings 21, each having a required number of rows of terminal receiving portions, are cut from the single continuous base plate, for example, of a fifty-row structure. The required number of terminals in each individual insulating housing 21 may be either odd or even. However, regardless of whether the number of the terminals is odd or even, the convex portions 27 on the upper insulating housing 21 need to be disposed corresponding to the projections 29 on the lower insulating housing 21, respectively.

Therefore, in this embodiment, in the case where the insulating housings 21, each having an odd number of terminals, are stacked together in a two-stage manner, two adjacent terminal receiving portions 26 are cut simultaneously or sequentially, and the lower insulating housing 21, having the odd number of terminals, is obtained from the single continuous base plate of the fifty-row structure, and by doing so, the convex portions 27 on the upper insulating housing 21 are disposed corresponding to the projections 29 on the lower insulating housing 21, respectively. Namely, the upper insulating housing 21 is shifted by one pitch with respect to the lower insulating housing 21.

On the other hand, in the case where the insulating housings 21, each having an even number of terminals, are stacked together in a two-stage manner, one terminal receiving portion 26 is cut, and the lower insulating housing 21, having the even number of terminals, is obtained from the single continuous base plate of the fifty-row structure, and by doing so, the convex portions 27 on the upper insulating housing 21 are disposed corresponding to the projections 29 on the lower insulating housing 21, respectively.

Depending on the construction of the connector, the single-stage insulating housing 21 may be used, and in this case this insulating housing is cut in a similar manner.

When the insulating housing 21 is cut, the retaining projections 28 appear respectively on the opposite side surfaces of each of the upper and lower insulating housings 21. On the other hand, long-arm retaining members 43 are formed respectively at opposite side walls of the cover member 42 as shown in FIG. 8, and retaining claws 44 are formed at distal ends of these retaining members 43, respectively. Support members 45 for supporting the insulating housings 21 are formed in a projected manner at lower ends of rear portions of the opposite side walls of the cover member 42, respectively.

When the insulating housings 21 are fitted in the cover member 42 as shown in FIGS. 8 and 10, the retaining projections 28 are retainingly engaged with the retaining claws 44, respectively. The insulating housings 21 are held by the support members 45 and a body of the cover member 42 in a fitted manner, so that the insulating housings 21 are fixed to the cover member 42.

Next, an example of use of the insulating housing in a cover member of the rectangular tube type will be described with reference to FIGS. 11 and 12.

Figure 11:
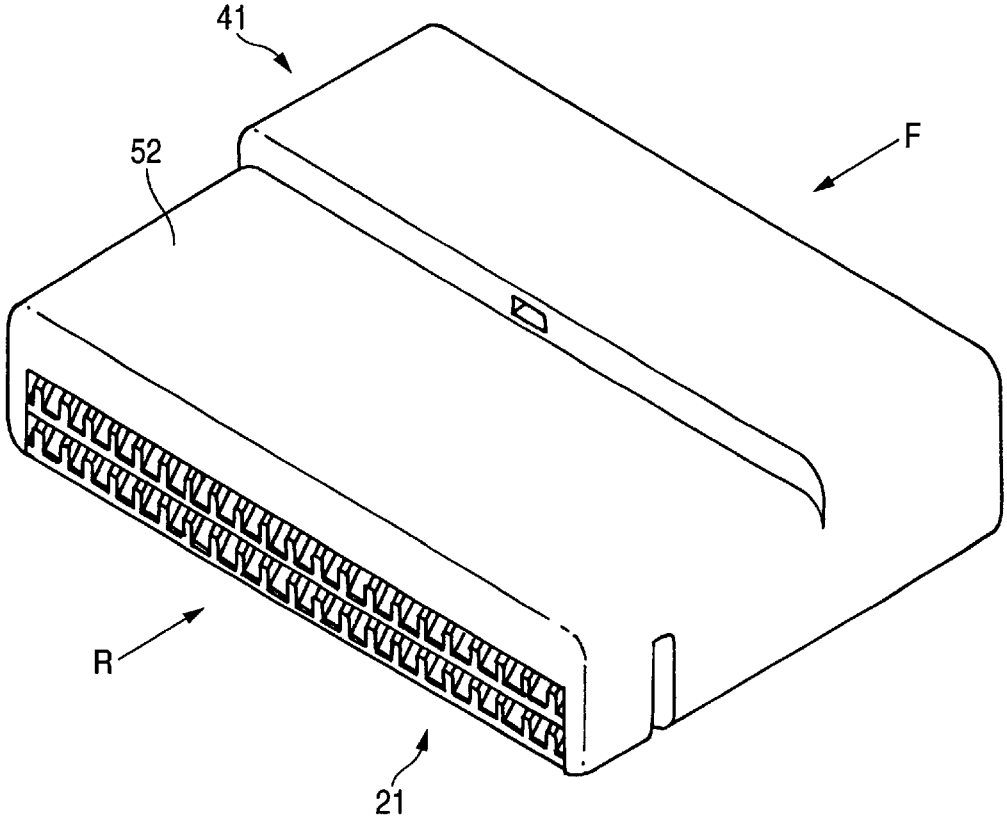
FIG. 11 is a perspective view of a connector having another cover member.
Figure 12:
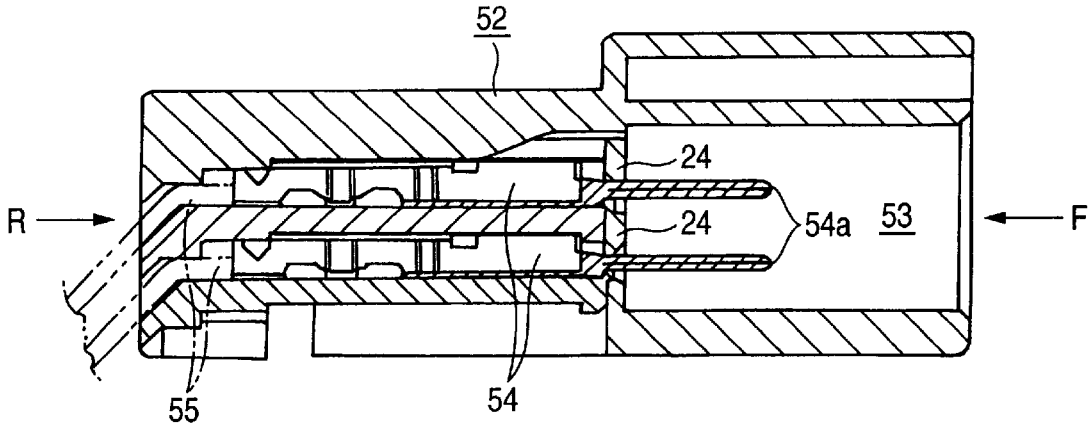
FIG. 12 is a cross-sectional view showing the construction of the connector.

As shown in FIG. 11, a connector 41 comprises insulating housings 21 which are stacked together in a two-stage manner, and are fitted in the cover member 52 of the rectangular tube type. A large opening 53 is formed in a front side F of the cover member 52, and bar-like connection portions 54*a* of male terminals 54, fixed to the insulating housings 21, project into this opening 53. Each insulating housing 21 has the bridge member 24, and therefore the deformation of the insulating housing 21 due to shrinking is prevented.

Wires 55 are connected by press-contacting to the male terminals 54, respectively, and are extended outwardly from the back side of the cover member 52 as indicated in imaginary lines.

The present invention is not limited to the above embodiments, but suitable changes and modifications can be made. For example, the material, shape, dimensions, form, number, arrangement, etc., of the base plate, the partition walls, the insulating housings, the terminals, the cover members, the connectors, the bridge members, the notches, the convex portions and so on, illustrated with respect to the above embodiments, may be arbitrary, and are not limited in so far as the present invention can be achieved.

As described above, the connector of the present invention includes the insulating housing which can be cut into a predetermined length, and includes the partition walls which are formed on the strip-like base plate, and extend continuously in the width direction of the base plate, and are juxtaposed at predetermined intervals in the longitudinal direction of the base plate. The bridge member bridges between any two adjacent ones of the partition walls, and the notches are formed respectively in those portions of the base plate disposed respectively corresponding to the bridge members.

With this construction, the base plate and the bridge member are formed integrally with the ends of the adjacent partition walls formed at the predetermined intervals, and the deformation due to shrinking after the molding can be prevented thanks to the cooperation of the bridge members with the base plate.

In the connector of the invention, the convex portion is formed on and projects from the bridge member in the direction of the thickness of the base plate, and the convex portion has the outer shape corresponding to the inner shape of the notch. Therefore, when the insulating housings are stacked together, the convex portions are fitted in the notches, respectively, thereby preventing the displacement and jolting of the base plates relative to each other, and also preventing the jolting of the cover member in which the insulating housings are fitted.

In the connector of the invention, the convex portions are formed alternately on those portions of the insulating housing each lying between the adjacent partition walls, and the insulating housings are stacked together in a plurality of stages, and the convex portions on an upper one of any two adjacent insulating housings are arranged in a staggered manner to the convex portions on the lower insulating housing. Therefore, the convex portion and the projection do not need to be provided at the same region, and therefore the mold structure for injection molding the insulating housing does not need to include a slide mold.

In the connector of the invention, the convex portions are formed respectively on those portions of the insulating housing each lying between the adjacent partition walls. Therefore, even if the base plate is cut at any position so that the insulating housings can be stacked together, the convex portions can be disposed respectively corresponding to the corresponding notches, and the insulating housings can be easily provided.

What is claimed is:

1. A connector comprising:

at least one insulating housing, including a strip-like base plate having a longitudinal direction thereof and a width direction thereof perpendicular to the longitudinal direction, the base plate being cut into a predetermined length in the longitudinal direction from a continuous plate which has a plurality of terminal receiving portions, a plurality of partition walls formed on the base plate, and extending continuously in the width direction of said base plate, and the partition walls being juxtaposed at a predetermined interval in the longitudinal direction of said base plate, a bridge member having bridging portions each of which bridges between two adjacent ones of said partition walls, and a plurality of notches each of which is formed at a position directly below said bridging portions on said base plate;

a plurality of terminals disposed respectively along said partition walls; and a cover member receivable said insulating housing.

2. A connector according to claim 1, wherein a plurality of convex portions project from said bridge member in a thickness direction of said base plate, and said convex portions have an outer shape corresponding to an inner shape of said notch.

3. A connector according to claim 2, wherein said convex portions are formed respectively on each of the bridging portions.

4. A connector according to claim 2, wherein said convex portions are engageable with said notches.

5. A connector according to claim 4, wherein a recess is formed on a back side of at least one of said convex portions and a projection is formed at a front end of said base plate in at least one of said notches, and said recess is engageable with said projection.

6. A connector according to claim 2, wherein said convex portions are alternately formed on one of each two of said bridging portions, said insulating housings are stacked in at least two stages, and said convex portions which are formed on an upper one of two stacked insulating housings are arranged in a staggered manner to said convex portions on a lower one of said two insulating housing.

7. A connector according to claim 6, wherein a projection is formed at a front end of said base plate in said notch directly below the other of said two bridging portions where said convex portion is not formed.

* * * * *